United States Patent [19]

Biermann et al.

[11] 4,239,257

[45] Dec. 16, 1980

[54] CROSS COUNTRY SKI BINDING

[75] Inventors: Peter Biermann, Leonberg; Rudi Feucht, Weissach; Manfred Schmidt, Sindelfingen; Ralf Storandt, Leonberg, all of Fed. Rep. of Germany

[73] Assignee: Vereinigte Baubeschlagfabriken Gretsch & Co. GmbH, Fed. Rep. of Germany

[21] Appl. No.: 880,110

[22] Filed: Feb. 22, 1978

[30] Foreign Application Priority Data

Feb. 23, 1977 [DE] Fed. Rep. of Germany ..... 2707626

[51] Int. Cl.[3] ..... A63C 9/18

[52] U.S. Cl. ..... 280/615

[58] Field of Search ..... 280/615, 614, 611; 36/117, 118, 119, 120, 121

[56] References Cited

U.S. PATENT DOCUMENTS

| | | | |
|---|---|---|---|
| 3,934,893 | 1/1976 | Greenleaf | 280/615 X |
| 4,108,467 | 8/1978 | Kreyenbuhl | 280/615 |

FOREIGN PATENT DOCUMENTS

| | | | |
|---|---|---|---|
| 2063163 | 6/1972 | Fed. Rep. of Germany | 280/614 |
| 2333042 | 4/1974 | Fed. Rep. of Germany | 280/615 |
| 2610041 | 10/1976 | Fed. Rep. of Germany | 280/615 |
| 2715907 | 10/1977 | Fed. Rep. of Germany | 280/615 |
| 47443 | 5/1909 | Switzerland | 280/615 |

*Primary Examiner*—John J. Love
*Assistant Examiner*—Milton L. Smith
*Attorney, Agent, or Firm*—Craig & Antonelli

[57] ABSTRACT

A cross country ski binding includes a support element which has a rear part clampingly engageable with a forward extension of a ski boot sole and a front part which is fixedly attachable to a ski. In order to accommodate angular movement between the front and rear parts, a latching mechanism is included which permits such angular movement about cross axes extending crosswise of the longitudinal extent of the ski when the binding is in an in-use position. The forward extension of the boot sole is formed as a short articulation part for hingedly connecting the boot to the latching mechanism. In preferred embodiments the forward boot sole extension formed as the articulation part extends less than 15 mm forwardly from the toe accommodating part of the boot, such that the boots can be comfortably walked in when not skiing.

20 Claims, 7 Drawing Figures

FIG.1
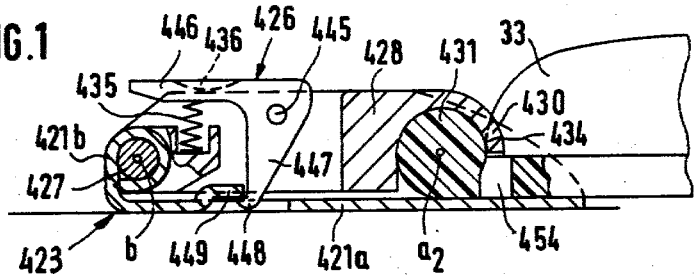
FIG. 2
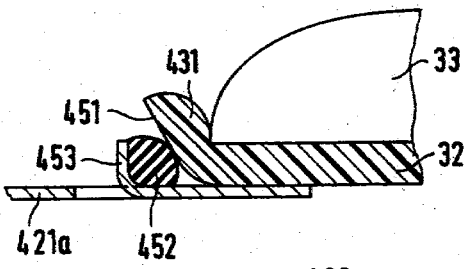
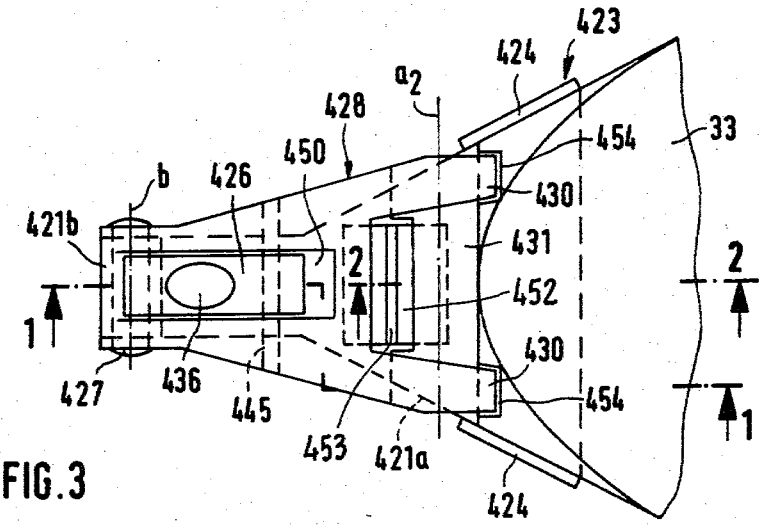
FIG.3

CROSS COUNTRY SKI BINDING

BACKGROUND AND SUMMARY OF THE INVENTION

The present invention relates to cross country ski bindings of the type described in commonly assigned copending application Ser. No. 849,447, filed Nov. 7, 1977. The subject matter of said application is incorporated herein by reference thereto, to the extent desired to facilitate an understanding of the present invention.

The invention concerns a cross country ski binding with a forward retaining device, to hold the front end of the shoe sole, which can be lifted from the ski at its rear end, whereby the forward end of the sole which extends over the toe part of the shoe is hingedly connected with the ski by articulation pieces that run crosswise with reference to the ski.

Cross country ski bindings of this kind that have been proposed heretofore have a forward sole extension that extends relatively far beyond the front end of the toe part of the shoe that is formed by the upper, as in the case of so-called pointed shoes. Such bindings, with suitably adapted shoes, offer many advantages for cross country skiing, but because of the sole extension they have the drawback that normal comfortable walking is substantially hampered when the skis are taken off. The inherent loss of comfort can again offset the advantages of these bindings. Also, the bending stresses caused by the sole extension readily lead to a break unless the quality and strength of the sole sufficiently takes these stresses into account.

The invention therefore is concerned with the problem of allowing comfortable walking with the shoes that are intended for the binding when skis are removed, and of diminishing or entirely eliminating the danger of a break in the shoe sole. The invention contemplates overcoming said problems by providing that the front end of the sole—corresponding to an ordinary shoe—extends only a short distance beyond the toe part of the shoe and itself constitutes an articulation part with the axis of the articulation running directly ahead of the toe part, crosswise to the direction of the length of the ski. In particularly preferred embodiments, the front end of the sole extends less than 15 millimeters beyond the toe part of the shoe.

Because of the very small projection of the sole, which is slight even if the transverse axis of articulation is relatively far from the toe part of the shoe, there is in any case a comfortable gait when the shoes are detached from the skis. Also, the bending stresses in the shoe sole are reduced to a minimum. Since moreover the shoe sole itself is effectively part of the crosswise articulation and of the binding respectively, there is at the same time a relatively simple construction of the binding part on the ski side. For engagement of the locking member and the front end of the sole for clamping or locking it in the retaining jaw, the sole end can be of a suitable configuration and provided with a hook-like projection, a groove or the like according to various preferred embodiments of the invention.

According to a further characteristic of certain embodiments of the invention, the front end of the sole is also clamped by the locking member in the retaining jaw. The retaining jaw and/or the locking member can be urged by spring action which presses or draws them against the ski.

If the shoe sole is firmly clamped in the retaining jaw by the locking member, in that it is drawn firmly forward against its V-shaped lateral jaw parts, a secure seat for the shoe in the binding is also ensured in certain preferred embodiments. By the cooperation of the retaining jaw and the locking member on the other hand, in spite of the slight projection that corresponds to the normal sole projection, in the preferred range of a maximum of 15 mm, a lifting of the shoe about another axis of articulation at the front is possible without any constraint. The forward part of the shoe sole is clamped in preferred embodiments between the retaining jaws by means of the locking member, like a vise, whereby the locking member and the retaining jaws advantageously can mutually yield, depending upon the lift of the shoe heel or the forces acting on the shoe.

In other embodiments of the invention in which the forward end of the sole itself constitutes an articulation part of the hinge-like articulation between the shoe and ski, the sole end, to produce the necessary movability about the transverse axis, is made as at least a partly cylindrical widened body, or like a cup, to cooperate with a correspondingly bulged part which may be fixed to the ski, or in a similar or correspondingly acting way. Resilient elements, preferably pads of elastic material such as rubber, or even in some embodiments the locking member itself, which can be made as a torsion or wire spring, can serve to effect a resetting action on the shoe sole if the shoe heel lifts off the ski.

Movable binding parts such as the locking member or the retaining jaws or other elements connected with them, such as guides or the like, are preferably made at the same time as grip elements and suitably disposed so that by depression of this part the binding can be released, in that for example in certain preferred arrangements the locking member will be removed from its lock setting and thereby its engagement with the front end of the sole will be interrupted.

These and further objects, features and advantages of the present invention will become more obvious from the following description when taken in connection with the accompanying drawings which show, for purposes of illustration only, several embodiments in accordance with the present invention.

BRIEF DESCRIPTION OF THE DRAWINGS

FIG. 1 is a side view of a first embodiment of the invention in partial cross section along line 1—1 of FIG. 3, with a forward sole end that constitutes an articulation part;

FIG. 2 is a longitudinal sectional view along line 2—2 of FIG. 3, parallel to the longitudinal section of FIG. 1;

FIG. 3 is a top view of FIGS. 1 and 2;

DETAILED DESCRIPTION OF THE DRAWINGS

Figure 4:
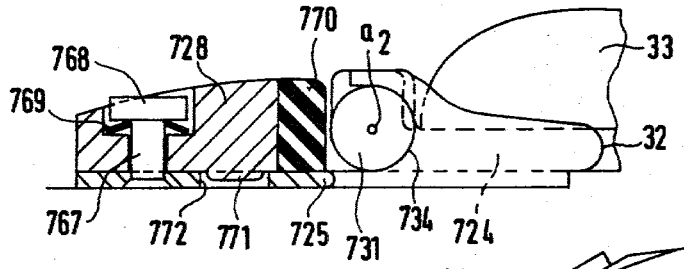
FIG. 4 is a side view of a second embodiment of the invention, partly in longitudinal section, with lateral jaw parts fixed to the ski and a laterally swingable locking member.

In the embodiment of FIGS. 1 to 3, locking member 428 is borne on a bearing or baseplate **421*a* that is fixed to the ski, with a hinge sleeve like bearing block 421***b* and lateral jaw parts 424 that are V-shaped in outline and inclined toward each other, so that it can be swung upward about axis b of articulating pin 427. Reference numeral 423 designates the support fixture which includes the baseplate 421*a*, the bearing block 421*b* and the lateral jaw parts 424. The rear end of the locking member 428 as shown in FIG. 3, is made in a fork configuration and engages over the cylindrically shaped forward thickened end 431 of shoe sole 32 of shoe 33 by means of bowl-shaped fork ends 430. Sole end 431 is thereby turnably clamped between fork ends 430 of locking member 428 and baseplate 421*a* which is fixed to the ski.

To clamp the two mentioned parts 428 and 421*a*, there is a locking or check lever 426 which serves as an angle lever, rotatably borne by means of articulation pin 445 in locking member 428 with a transverse axis of pivoting. The upper horizontal lever arm 446 is made as a grip member with a depression 436, while the other downwardly directed lever arm 447 presents a locking hook 448 that in the position of use illustrated in FIG. 1 engages under a projection 449 in baseplate 421*a* and is held in this position by a spring 435. The locking or check lever 426 is hereby disposed inside a recess 450 of locking lever 428.

Between the fork ends 430 of locking lever 428, the thickened forward end 431 of shoe sole 32 is partly recessed or provided with a flattening 451, as shown in FIG. 2. It bears with its flattened part 451 against an elastic pad 452 that bears on the baseplate 421*a*, on a shoulder 453 thereof. If during skiing the shoe heel is raised from the ski and tends thereby to turn shoe 33 about a transverse axis $a_2$ of articulation, with reference to the ski, the thickened forward end 431 of the shoe sole will be pressed against the elastic, e.g. rubber pad 452 in such a way that the deforming pad 452, because of its elasticity—possibly in conjunction with the deformability of the front end 431 of the shoe sole—will exert a resetting action on the shoe so that it will be pressed back onto the ski. To make the angular movement of shoe sole 32 with reference to locking member 428 possible, the sole in this embodiment is provided with recesses 454 into which the bowl-shaped fork ends 430 of the locking member can penetrate.

To release the binding, locking lever 426 on its upper lever arm 446 is pressed downward so that the locking hook 448 is disengaged from shoulder 449 on the baseplate, whereupon the locking member 428 can be swung upward about its axis b and thereby shoe 33 will be released from the binding.

Figure 5:
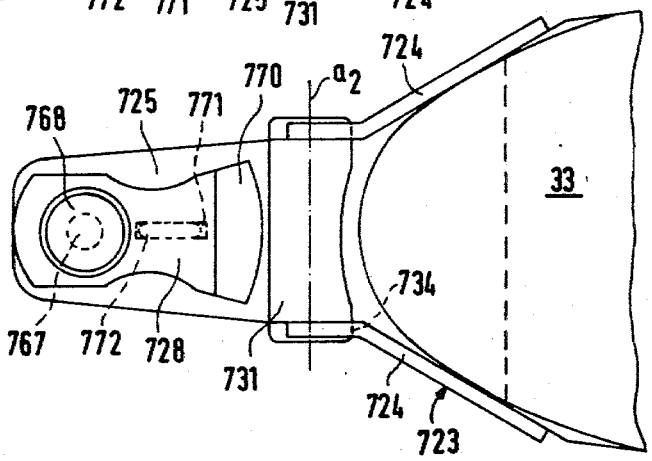
FIG. 5 is a top view of FIG. 4.

In the embodiment according to FIGS. 4 and 5, more or less corresponding parts are indicated by the same reference numerals as before, but they start with 700.

The front end 731 of shoe sole 32 is made at least partly cylindrical, and it is introduced from the front into the side jaw parts 724 fixed to the ski which are provided with a corresponding round recess 734, in such a way that shoe sole 32 can swing about axis $a_2$ of the forward sole end 731 or recess 734 upward, counterclockwise (FIG. 4). To secure the shoe sole against slipping out to the front, there is a locking member 728 which is set so that it can be turned about bearing pin 767, which is perpendicular to the ski and riveted to baseplate 725 fixed to the ski. Lateral jaw parts 724 are fixedly connected to the baseplate 725 and the locking member 728 is secured against lifting off from the baseplate 725 by the head of pin 767, which head constitutes a stop for a spring 769 which presses locking member 728 downward against base plate 725. The spring 769 is advantageously made as a plate spring. A pad 770 of elastic material, fixedly disposed on locking member 728, is applied without clearance or even with clamping in the middle setting or position of use of the binding, ahead of the front end 731 of the sole, which at the same time elastically receives shearing stresses that act on the shoe toward the front, and especially effects a restoration of the shoe when it is turned.

To release the binding, locking member 728 can be swung out of its mid position illustrated in FIG. 5, to one side or the other about the axis of bearing pin 767. To lock the locking member in the mid position, there is a lock projection 771 on the locking member, which in the mid position engages in a recess 772 in baseplate 725.

Figure 6:
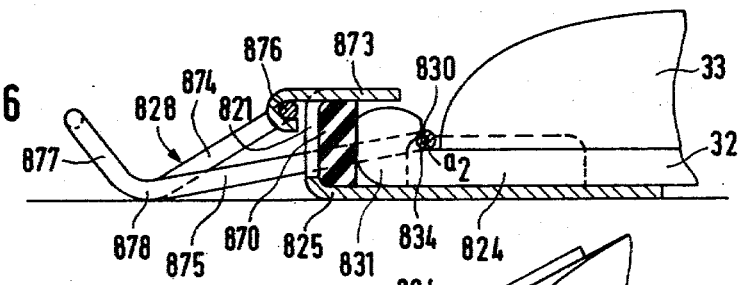
FIG. 6 is a side view of a third embodiment of the invention, partly in longitudinal section, likewise with lateral jaw parts fixed to the ski and resilient locking member.
Figure 7:
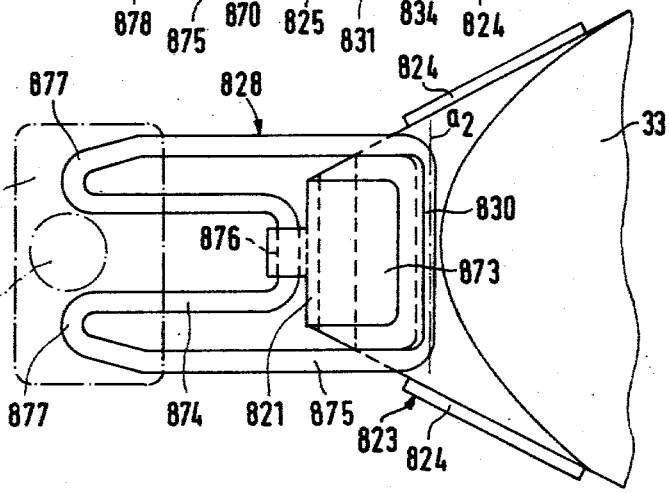
FIG. 7 is a top view of FIG. 6.

In the example of embodiment as in FIGS. 6 and 7, in which parts that more or less correspond again are given the same reference numerals, starting with 800 however, again the forward thickened and rounded end 831 of shoe sole 32 itself acts as an articulation part in a movement in which the shoe heel lifts from the ski. The shoe sole, for this purpose, has a groove-like depression 834, in which the rear transverse arcuate member 830 of the locking member 828 (made as an endless closed resilient wire strap) engages when the shoe is clamped. A lifting out of the shoe 33 from the lateral jaw parts 824 is prevented by a backwardly bent tongue-like wall part 873 of a bearing block 821 which is U-shaped and open toward the rear, which block with its wall part 873 engages over the rounded end 831 of the shoe sole and constitutes a part of the baseplate 825 that is fixed to the ski and fixedly connected with the side jaw parts 824. In the rearwardly open U of bearing block 821, there is a pad 870 of elastic material such as rubber or the like, against which the front end 831 of the shoe sole is applied, in such a way that when the shoe is swung up it deforms the elastic pad 870 and is thereby restored to its position.

The wire arcuate member that serves as locking member 828 consists of two U-shaped parts 874 and 875, one inside the other, whereof the inner smaller arcuate part 874 is rotatably borne by means of transverse section 876 on bearing block 821 and by means of its forwardly directed U arm is connected with the correspondingly directed U arms of the outer, larger arcuate member 875, whose transverse member in turn engages, as locking element 830, in depression 834 on the front end 831 of the sole. The two arcuate members or parts 874 and 875 are bent in such a way that on the one hand, in the closed position of the binding, they can bear at 878 on the ski surface and on the other hand on their connecting forward transverse members 877 they can be used as a grip. Members 874 and 875 moreover are so disposed with respect to each other, e.g. converging in side view as a V, that the wire arcuate spring serving as locking member 828 will automatically be locked against shearing stresses in the long direction of the ski. To open the binding, locking member 828 is folded up so that the transverse member 830 will issue from depression 834, whereupon the shoe can be drawn out of the binding toward the back.

The front end 875 of the wire arcuate spring with the connecting transverse parts 877 can be covered with a plate 878' (dash lines FIG. 7) that has a depression 836, so tht the binding can be closed by pressure on the plate, by a ski pole or by hand.

While we have shown and described several embodiments in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. Cross country ski binding apparatus comprising:

a ski boot having a forward sole extension formed as a unitary portion of the material forming the sole of the ski boot, forward ski boot support element means fixedly attachable to a ski, said support element means including means supportingly engageable with the forward sole extension of the ski boot while permitting lifting of the rear part of said ski boot from the ski, and latching means for engaging said support element means with said forward sole extension to latch said sole extension to said ski while permitting hinged movement of the ski boot with respect to said ski about a hinge articulation axis extending crosswise to the ski, said forward sole extension extending a short distance beyond the toe part of the shoe, the forward end of the sole extension forming a hinge articulation part cooperating with the latching means and the support element means to permit said hinged movement about said articulation axis extending through said articulation part, wherein said latching means includes retaining jaw means for restraining movement of said ski boot in lateral directions and a locking member for clamping said forward sole extension against upward movements, and wherein, by means of an arcuate transverse member that engages behind the hinge articulation part in a depression in the forward sole extension, the locking member is in engagement with the forward sole extension, clamping it toward the front against lateral jaw parts of said retaining jaw means.

2. Cross country ski binding apparatus comprising:

a ski boot having a forward sole extension formed as a unitary portion of the material forming the sole of the ski boot, forward ski boot support element means fixedly attachable to a ski, said support element means including means supportingly engageable with the forward sole extension of the ski boot while permitting lifting of the rear part of said ski boot from the ski, and latching means for engaging said support element means with said forward sole extension to latch said sole extension to said ski while permitting hinged movement of the ski boot with respect to said ski about a hinge articulation axis extending crosswise to the ski, said forward sole extension extending a short distance beyond the toe part of the shoe, the forward end of the sole extension forming a hinge articulation part cooperating with the latching means and the support element means to permit said hinged movement about said articulation axis extending through said articulation part, wherein said latching means includes retaining jaw means for restraining movement of said ski boot in lateral directions and a locking member for clamping said forward sole extension against upward movements, the articulation part is made as a thickened rounded articulation part, to cooperate with a correspondingly shaped locking member forming part of the latching means, wherein said thickened rounded articulation part is a somewhat cylindrical front end of the shoe, and wherein the locking member engages the somewhat cylindrical front end of the shoe by means of a bowlshaped part, and is held in its engaged position by a resilient locking lever.

3. Cross country ski binding apparatus according to claim 2, wherein the locking lever on the locking member is a doubled-armed lever, whereof one arm is made as a spring-loaded pressure member, and the other arm is made as a check pawl that engages under a projection fixed to the ski, such as a baseplate or a bearing block.

4. Cross country ski binding apparatus according to claim 3, wherein the locking lever is disposed in a recess of the locking member.

5. Cross country ski binding apparatus according to claim 2, wherein the locking lever is disposed in a recess of the locking member.

6. Cross country ski binding apparatus comprising:

a ski boot having a forward sole extension formed as a unitary portion of the material forming the sole of the ski boot, forward ski boot support element means fixedly attachable to a ski, said support element means including means supportingly engageable with the forward sole extension of the ski boot while permitting lifting of the rear part of said ski boot from the ski, and latching means for engaging said support element means with said forward sole extension to latch said sole extension to said ski while permitting hinged movement of the ski boot with respect to said ski about a hinged articulation axis extending crosswise to the ski, said forward sole extension extending a short distance beyond the toe part of the shoe, the forward end of the sole extension forming a hinge articulation part cooperating with the latching means and the support element means to permit said hinged movement about said articulation axis extending through said articulation part, wherein said latching means includes retaining jaw means for restraining movement of said ski boot in lateral directions and a locking member for clamping said forward sole extension against upward movements, the articulation part is made as a thickened rounded articulation part, to cooperate with a correspondingly shaped locking member forming part of the latching means, and wherein the thickened rounded articulation part partly has an especially out-of-round or flattened configuration and is applied against an elastic pad in such a way that when the shoe heel is lifted off the ski, the pad exerts a re-positioning action on the shoe sole.

7. Cross country ski binding apparatus comprising:

a ski boot having a forward sole extension formed as a unitary portion of the material forming the sole of the ski boot, forward ski boot support element means fixedly attachable to a ski, said support element means including means supportingly engageable with the forward sole extension of the ski boot while permitting lifting of the rear part of said ski boot from the ski, and latching means for engaging said support element means with said forward sole extension to latch said sole extension to said ski while permitting hinged movement of the ski boot with respect to said ski about a hinged articulation axis extending crosswise to the ski, said forward sole extension extending a short distance beyond the toe part of the shoe, the forward end of the sole extension forming a hinge articulation part cooperating with the latching means and the support element means to permit said hinged movement about said articulation axis extending through said articulation part, wherein said latching means includes retaining jaw means for restraining movement of said ski boot in lateral directions and a locking member for clamping said forward sole extension against upward movements, and wherein the locking member is rotatably borne on the ski to rotate about an axis that is perpendicular to the ski in the vertical direction.

8. Cross country ski binding apparatus according to claim 7, wherein the articulation part of the forward sole extension is insertable from the front between lateral jaw parts of said jaw means that are fixed to the ski and allow a swinging motion about said axis and secured in the locked position against coming out at the front, by the rotatable locking member.

9. Cross country ski binding apparatus according to claim 7, wherein the locking member presents an elastic pad made of rubber, or the like, on its end that secures the articulation part against coming out toward the front.

10. Cross country ski binding apparatus according to claim 7, wherein the locking member is springingly pressed against its bearing surface.

11. Cross country ski binding apparatus according to claim 10, wherein the locking member is borne on a bearing pin fixed to the ski, and disposed between an upper head of the bearing pin and the locking member there is a spring, preferably a plate spring.

12. Cross country ski binding apparatus comprising:

a ski boot having a forward sole extension formed as a unitary portion of the material forming the sole of the ski boot, forward ski boot support element means fixedly attachable to a ski, said support element means including means supportingly engageable with the forward sole extension of the ski boot while permitting lifting of the rear part of said ski boot from the ski, and latching means for engaging said support element means with said forward sole extension to latch said sole extension to said ski while permitting hinged movement of the ski boot with respect to said ski about a hinged articulation axis extending crosswise to the ski, said forward sole extension extending a short distance beyond the toe part of the shoe, the forward end of the sole extension forming a hinge articulation part cooperating with the latching means and the support element means to permit said hinged movement about said articulation axis extending through said articulation part, wherein said latching means includes retaining jaw means for restraining movement of said ski boot in lateral directions and a locking member for clamping said forward sole extension against upward movements, resilient means are provided for resiliently biasing at least one of said retaining jaw means and said locking member into operative boot holding positions, and wherein the locking member is rotatably borne on the ski to rotate about an axis that is perpendicular to the ski in the vertical direction.

13. Cross country ski binding apparatus comprising:

a ski boot having a forward sole extension formed as a unitary portion of the material forming the sole of the ski boot, forward ski boot support element means fixedly attachable to a ski, said support element means including means supportingly engageable with the forward sole extension of the ski boot while permitting lifting of the rear part of said ski boot from the ski, and latching means for engaging said support element means with said forward sole extension to latch said sole extension to said ski while permitting hinged movement of the ski boot with respect to said ski about a hinged articulation axis extending crosswise to the ski, said forward sole extension extending a short distance beyond the toe part of the shoe, the forward end of the sole extension forming a hinge articulation part cooperating with the latching means and the support element means to permit said hinged movement about said articulation axis extending through said articulation part, wherein said latching means includes retaining jaw means for restraining movement of said ski boot in lateral directions and a locking member for clamping said forward sole extension against upward movements, and wherein the locking member is made as a springing arcuate piece and has the form of a pair of U-shaped members with front ends of one of the U-shaped members being connected with the respective front ends of the other U-shaped member by a transverse part, the transverse part of one, advantageously an inner U-shaped member being fixedly borne on the ski and the transverse part of the other, advantageously an outer U-shaped member, being arranged for engagement with the hinge articulation, and the locking member in the locked position bearing, in the region of the forward ends of the U-shaped members, on one of the skis and a part fixed to the ski.

14. Cross country ski binding apparatus according to claim 13, wherein the hinge articulation part is secured against lifting off the ski by an approximately U-shaped part that is fixed to the ski and bent backward to form a bearing block for the hinge articulation part which can turn about a transverse axis of the ski.

15. Cross country ski binding apparatus according to claim 14, wherein the hinge articulation part is applied against an elastic pad fixed in the U-shaped part that is fixed to the ski by means of the locking member that is made as a springing arcuate piece.

16. Cross country ski binding apparatus according to claim 14, wherein, in the locked position of the locking member, the transverse part that serves to fix the locking member on the ski is above the transverse part which is engaged with the hinge articulation part, or above a dead point position of the locking member, and the U-shaped members converge in side view in more or less a V-shape against a lower bearing point fixed on the ski.

17. Cross country ski binding apparatus according to claim 1, wherein a grip is provided for releasing said latching means.

18. Cross country ski binding apparatus according to claim 13, wherein said short distance is less than 15 mm.

19. Cross country ski binding apparatus comprising:

a ski boot having a forward sole extension formed as a unitary portion of the material forming the sole of the ski boot, forward ski boot support element means fixedly attachable to a ski, said support element means including means supportingly engageable with the forward sole extension of the ski boot while permitting lifting of the rear part of said ski boot from the ski, and latching means for engaging said support element means with said forward sole extension to latch said sole extension to said ski while permitting hinged movement of the ski boot with respect to said ski about a hinged articulation axis extending crosswise to the ski, said forward sole extension extending a short distance beyond the toe part of the shoe, the forward end of the sole extension forming a hinge articulation part cooperating with the latching means and the support element means to permit said hinged movement about said articulation axis extending through said articulation part, wherein said latching means includes retaining jaw means for restraining movement of said ski boot in lateral directions and a locking member for clamping said forward sole extension against upward movements, a grip is provided for releasing said latching means, and wherein a lever or the like that is articulatedly or springingly connected with the locking member is made as the grip.

20. Cross country ski binding apparatus comprising:

a ski boot having a forward sole extension formed as a unitary portion of the material forming the sole of the ski boot, forward ski boot support element means fixedly attachable to a ski, said support element means including means supportingly engageable with the forward sole extension of the ski boot while permitting lifting of the rear part of said ski boot from the ski, and latching means for engaging said support element means with said forward sole extension to latch said sole extension to said ski while permitting hinged movement of the ski boot with respect to said ski about a hinged articulation axis extending crosswise to the ski, said forward sole extension extending a short distance beyond the toe part of the shoe, the forward end of the sole extension forming a hinge articulation part cooperating with the latching means and the support element means to permit said hinged movement about said articulation axis extending through said articulation part, wherein said latching means includes retaining jaw means for restraining movement of said ski boot in lateral directions and a locking member for clamping said forward sole extension against upward movements, and wherein, by means of an arcuate transverse member than engages in a groove-like depression in the forward sole extension the locking member is in engagement with the hinge articulation part clamping it toward the front against lateral jaw parts of said retaining jaw means.

* * * * *